US010961030B2

(12) United States Patent
Lucas, Jr.

(10) Patent No.: US 10,961,030 B2
(45) Date of Patent: Mar. 30, 2021

(54) SLIDABLY OPENABLE CHILD RESISTANT CONTAINER

(71) Applicant: CSP TECHNOLOGIES, INC., Auburn, AL (US)

(72) Inventor: Franklin Lee Lucas, Jr., Opelika, AL (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 68 days.

(21) Appl. No.: 15/960,768

(22) Filed: Apr. 24, 2018

(65) Prior Publication Data

US 2018/0305092 A1 Oct. 25, 2018

Related U.S. Application Data

(60) Provisional application No. 62/489,038, filed on Apr. 24, 2017.

(51) Int. Cl.
*B65D 50/04* (2006.01)
*A61J 1/03* (2006.01)
(Continued)

(52) U.S. Cl.
CPC ..... *B65D 50/046* (2013.01); *A61J 1/03* (2013.01); *B65D 11/12* (2013.01); *B65D 43/20* (2013.01); *B65D 2215/02* (2013.01)

(58) Field of Classification Search
CPC ..... B65D 50/046; B65D 50/045; B65D 2215/02; B65D 2215/04; B65D 43/20; B65D 11/12; A61J 1/03
(Continued)

(56) References Cited

U.S. PATENT DOCUMENTS 3,621,989 A * 11/1971 Pregont ..... B65D 75/326 206/468
3,854,905 A * 12/1974 Balzer ..... B64D 37/10 96/220
(Continued)

FOREIGN PATENT DOCUMENTS

EP 0603090 A1 6/1994
EP 1582476 A1 10/2005
(Continued)

OTHER PUBLICATIONS

International Search Report for PCT/US2007/006693 dated May 26, 2008.
(Continued)

*Primary Examiner* — James N Smalley
*Assistant Examiner* — Jennifer Castriotta
(74) *Attorney, Agent, or Firm* — David B. Gornish; Eckert Seamans Cherin & Mellott, LLC

(57) ABSTRACT

A child resistant container includes a first component having a first coupling mechanism, and a second component having a second coupling mechanism slidably coupled to the first coupling mechanism. The container is configured to move between a FIRST position and a SECOND position. When the container is in the FIRST position, the first and second components form a compartment configured to contain at least one product. When the container moves from the FIRST position toward the SECOND position, the first component slides relative to the second component, thereby providing an opening into the compartment.

12 Claims, 5 Drawing Sheets

(51) Int. Cl.
*B65D 6/06* (2006.01)
*B65D 43/20* (2006.01)

(58) Field of Classification Search
USPC ..... 220/345.1–345.4; 206/1.5, 807
See application file for complete search history.

(56) References Cited

U.S. PATENT DOCUMENTS 3,923,188 A * 12/1975 Lake, Jr. ..... B64G 1/402 220/501
4,126,224 A 11/1978 Laauwe et al.
4,170,315 A 10/1979 Dubach et al.
4,244,495 A 1/1981 Lorscheid et al.
4,260,067 A 4/1981 Andruchiw
4,387,730 A 6/1983 Shioi
4,512,484 A 4/1985 Mar
4,746,008 A 5/1988 Heverly et al.
4,809,874 A 3/1989 Pehr
4,844,284 A * 7/1989 Drozd ..... B65D 50/045 220/281
4,892,208 A 1/1990 Sledge
4,972,860 A 11/1990 Yuhara et al.
4,974,735 A 12/1990 Newell et al.
5,012,941 A 5/1991 Abrams et al.
5,031,784 A 7/1991 Wright
5,040,691 A 8/1991 Hayes et al.
5,083,671 A 1/1992 Hayes
5,137,260 A 8/1992 Pehr
5,270,011 A 12/1993 Altherr
5,353,946 A 10/1994 Behrend
5,427,265 A 6/1995 Cautereels et al.
5,433,588 A * 7/1995 Monk ..... F04B 43/1253 417/477.2
5,526,953 A 6/1996 Chieng
5,577,779 A 11/1996 Dangel
5,579,957 A 12/1996 Gentile et al.
5,636,756 A 6/1997 Johnson
5,785,179 A 7/1998 Buczwinski et al.
5,819,967 A 10/1998 Lo
5,908,037 A 6/1999 Pierson
5,911,937 A 6/1999 Hekal
6,036,036 A 3/2000 Bilani et al.
6,080,350 A 6/2000 Hekal
6,082,572 A 7/2000 Galton-Fenzi et al.
6,124,006 A 9/2000 Hekal
6,130,263 A 10/2000 Hekal
6,174,952 B1 1/2001 Hekal et al.
6,176,381 B1 1/2001 Mader
6,214,255 B1 4/2001 Hekal
6,221,446 B1 4/2001 Hekal
6,398,067 B1 6/2002 Belfance et al.
6,486,231 B1 11/2002 Hekal
6,523,690 B1 2/2003 Buck et al.
6,613,405 B1 9/2003 Hekal
6,662,454 B2 12/2003 Harrold
6,772,902 B1 8/2004 White
6,986,434 B1 1/2006 Getsy et al.
7,000,792 B2 2/2006 Arai
7,005,459 B2 2/2006 Hekal
7,213,720 B2 5/2007 Giraud
7,296,711 B2 11/2007 Hayakawa et al.
7,404,495 B2 7/2008 Keung
7,537,137 B2 5/2009 Giraud
7,581,656 B2 9/2009 Gnepper et al.
7,611,024 B2 11/2009 Yamanaka et al.
7,654,411 B2 2/2010 Boots et al.
7,717,284 B2 5/2010 Giusti
7,721,907 B2 5/2010 Keung
7,735,665 B2 6/2010 Robinson
7,798,348 B2 9/2010 Sawyer
7,861,873 B1 1/2011 Bragg et al.
8,051,998 B1 11/2011 Giraud et al.
8,141,731 B2 3/2012 Mazurkiewicz et al.
8,167,156 B2 5/2012 Milante
8,172,101 B2 5/2012 Giusti
8,235,233 B2 8/2012 Pehr
8,240,491 B2 8/2012 Beecroft et al.
8,292,101 B1 10/2012 Bragg et al.
8,292,110 B2 10/2012 Rutter et al.
8,469,212 B2 6/2013 Goto et al.
8,479,935 B2 7/2013 Straughan
8,528,778 B2 9/2013 Giraud
8,550,269 B2 10/2013 Lane
D696,078 S 12/2013 Allen
8,596,493 B2 12/2013 Vollers et al.
D732,684 S 6/2015 Ooi et al.
9,056,703 B2 6/2015 Brown et al.
9,352,889 B2 5/2016 Giraud et al.
2003/0102323 A1 6/2003 Lohn
2005/0023285 A1 2/2005 Keung
2005/0205607 A1 9/2005 Hierzer et al.
2005/0242105 A1 11/2005 Homann
2006/0043100 A1 3/2006 Johnson et al.
2006/0096984 A1 5/2006 Bandoh et al.
2006/0186077 A1 8/2006 Robinson
2007/0023317 A1 2/2007 Brozell et al.
2007/0170191 A1 7/2007 Arvidsson et al.
2007/0228042 A1 10/2007 Yeager
2007/0284277 A1* 12/2007 Gnepper ..... B65D 11/12 206/528
2008/0110933 A1 5/2008 Goncalves
2008/0169261 A1 7/2008 Druitt et al.
2008/0308568 A1 12/2008 Grenier et al.
2010/0051572 A1 3/2010 Beecroft et al.
2011/0067363 A1 3/2011 Sprada et al.
2012/0055929 A1 3/2012 Hayton et al.
2013/0082059 A1 4/2013 Huang
2015/0048088 A1 2/2015 Giraud et al.

FOREIGN PATENT DOCUMENTS

EP 2050685 A1 4/2009
ES 2332979 2/2010
GB 2082552 A 3/1982
GB 2166423 A 5/1986
GB 2449505 A 11/2008
JP H0986550 A 3/1997
JP H09315455 A 12/1997
JP 2003104429 A 4/2003
WO 9825836 A1 6/1998
WO 2007065240 A1 6/2007

OTHER PUBLICATIONS

Written Opinion for PCT/US2007/006693 dated Jun. 10, 2008.
International Preliminary Report on Patentability for PCT/US2007/006693 dated Sep. 23, 2008.

* cited by examiner

SLIDABLY OPENABLE CHILD RESISTANT CONTAINER

CROSS-REFERENCE TO RELATED APPLICATION

This application claims priority from and claims the benefit of United States Provisional Patent Application Ser. No. 62/489,038, filed Apr. 24, 2017, and entitled "CHILD RESISTANT CONTAINER WITH SLIDABLE PRODUCT COMPARTMENT".

FIELD OF THE INVENTION

The invention relates generally to child resistant containers, and in particular to a child resistant container wherein a first component is configured to slide relative to a second component.

BACKGROUND

Medication (e.g., without limitation, prescription and non-prescription pills) is often stored in containers. While known containers provide a reliable mechanism to store medication, they suffer from a number of disadvantages. Among those is the fact that many of the containers are not particularly difficult to open. Why this is problematic is that if the containers can be opened too readily, then children might be able to inadvertently open them and gain access to the medication inside. Ingestion of the medication in even small doses by a child not intended to be the recipient of that medication could cause physical harm and even death. As such, there is a need for an improved child resistant container.

SUMMARY OF THE INVENTION

Accordingly, in one aspect there is provided a child resistant container. The container includes a first component having a first coupling mechanism, and a second component having a second coupling mechanism slidably coupled to the first coupling mechanism. The container is configured to move between a FIRST position and a SECOND position. When the container is in the FIRST position, the first and second components form a compartment configured to contain at least one product. When the container moves from the FIRST position toward the SECOND position, the first component slides relative to the second component, thereby providing an opening into the compartment.

BRIEF DESCRIPTION OF THE DRAWINGS

Exemplary embodiments of the present invention are shown in the enclosed drawings as follows.

DETAILED DESCRIPTION OF THE PREFERRED EMBODIMENTS

As used herein, the word "unitary" means a component that is created as a single piece or unit. Under this definition, a component that includes pieces that are created separately and then coupled together as an assembled unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one. As employed herein, the statement that two or more parts are "connected" or "coupled" together shall mean that the parts are joined together either directly or joined through one or more intermediate parts.

Figure 1:
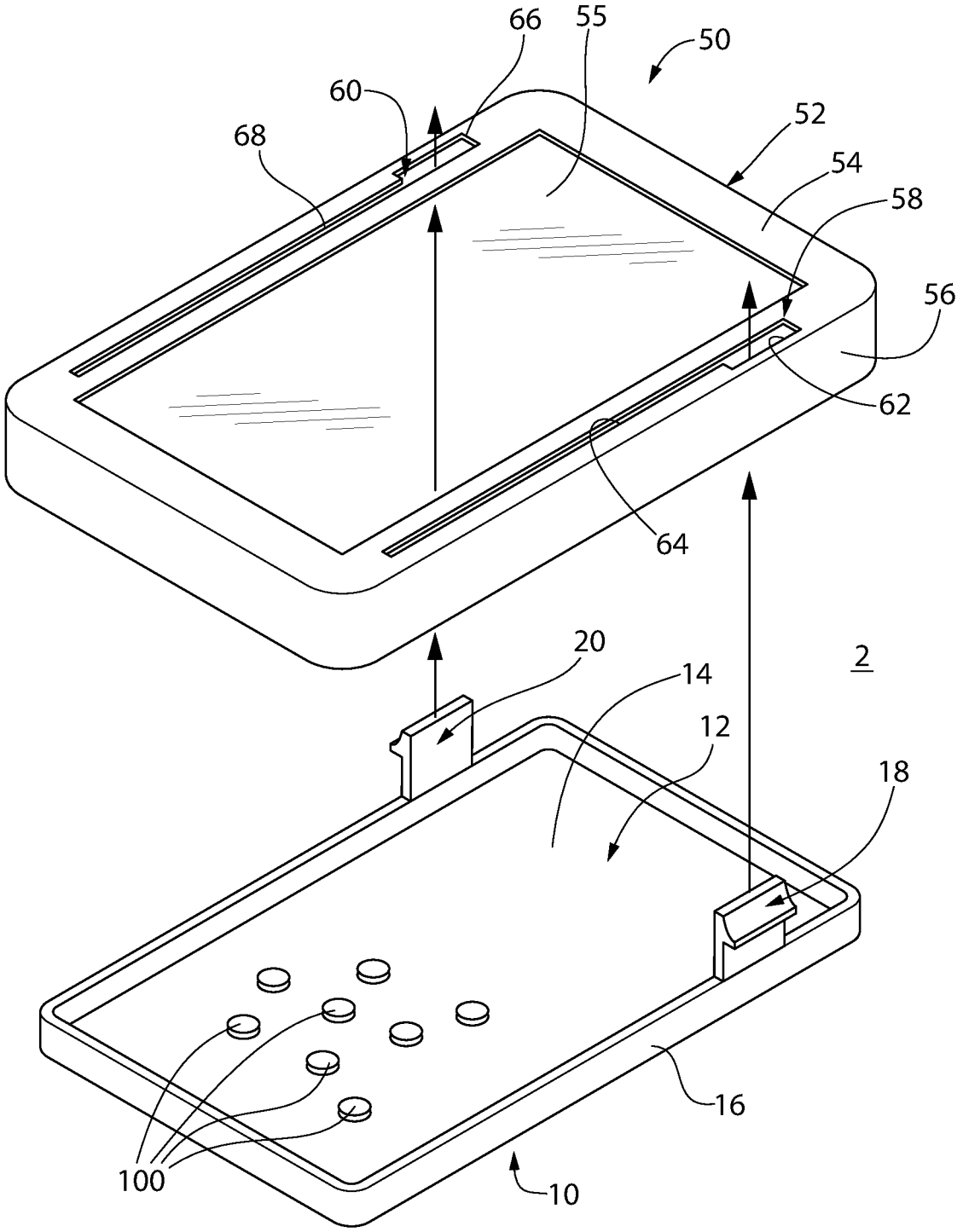
FIG. 1 is an exploded isometric view of a child resistant container, shown with a number of pills on a component, in accordance with one non-limiting embodiment of the disclosed concept.

FIG. 1 is an exploded isometric view of a child resistant container 2, in accordance with one non-limiting embodiment of the disclosed concept. As will be discussed in greater detail below, container 2 is configured to contain medicine (e.g., without limitation, pills 100), and is further configured to provide a novel mechanism that minimizes the likelihood that a child will inadvertently open container 2. As shown, container 2 includes a first component 10 and a second component 50 configured to be slidably coupled to first component 10. First component 10 includes a body portion 12 having a floor portion 14 and a peripheral rim 16 extending from and optionally being oriented substantially perpendicular to floor portion 14. Additionally, first component 10 further includes a first coupling mechanism in the form of a number of protrusions 18,20 extending outwardly from body portion 12 (e.g., outwardly from peripheral rim 16 away from floor portion 14). Optionally, the number of protrusions 18,20 are two in number and are disposed directly opposite each other. In one example embodiment, first component 10 is a unitary component made from a single piece of material (e.g., without limitation, an injection molded piece). Furthermore, as will be discussed below, in the illustrative embodiment of FIG. 1, protrusions 18,20 are configured to flex inwardly.

Second component 50 includes a body portion 52 having a ceiling portion 54 and a peripheral rim 56 extending from and being located substantially perpendicular to ceiling portion 54. Furthermore, second component 50 has a second coupling mechanism in the form of a number of slots 58,60 formed in ceiling portion 54. It will be appreciated that slots 58,60 are slidably coupled to protrusions 18,20 of first component 10. Continuing to refer to FIG. 1, slots 58,60 each include a corresponding enlarged portion 62,66 and a corresponding sliding portion 64,68 extending from the enlarged portion 62,66. When protrusions 18,20 are disposed in sliding portions 64,68, protrusions 18,20 are biased toward an exterior of container 2, as will be discussed below.

Figure 2:
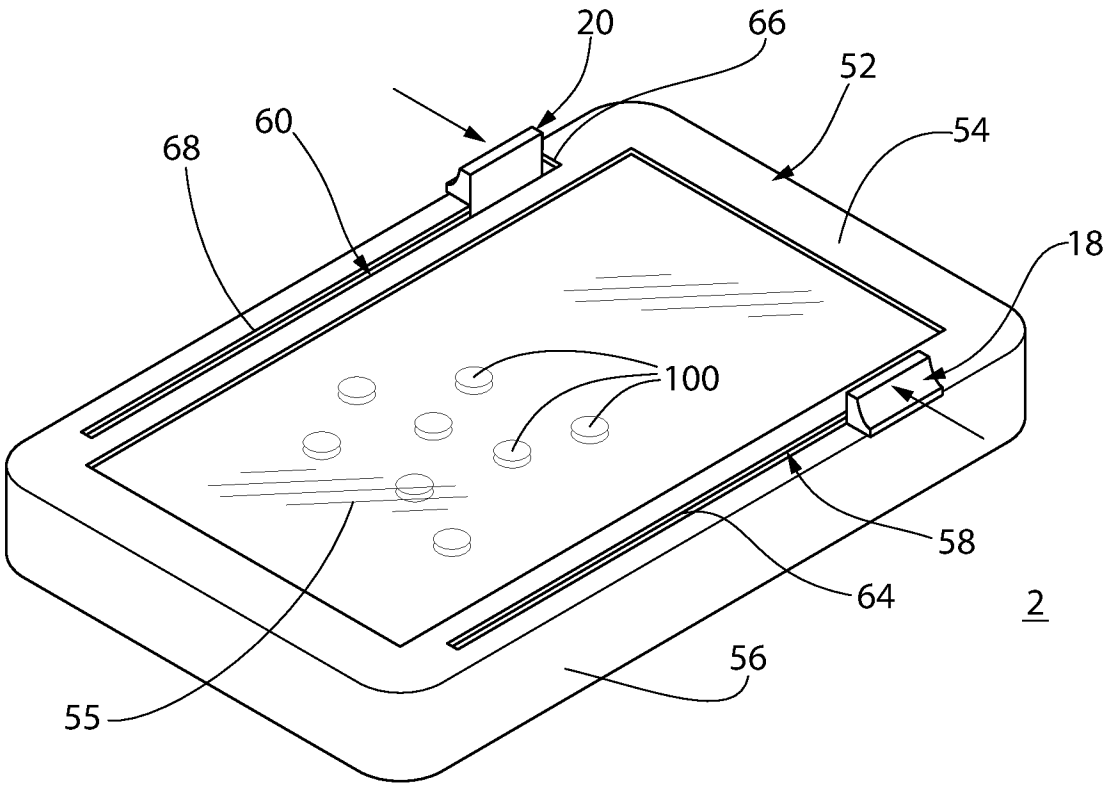
FIG. 2 is an assembled isometric view of the container of FIG. 1, shown with the container in a FIRST position.
Figure 4:
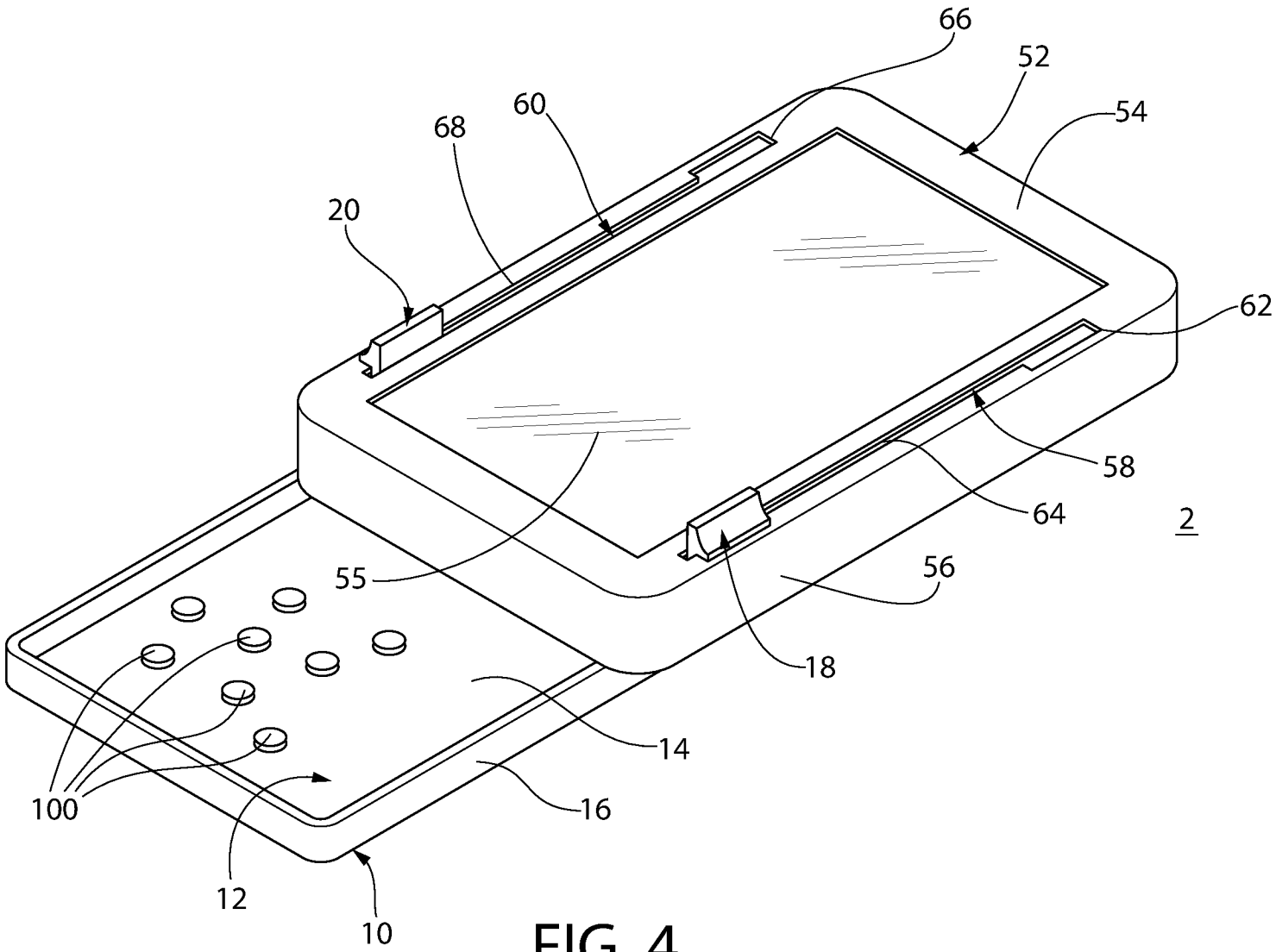
FIG. 4 is another assembled isometric view of the container of FIG. 1, shown with the container in the SECOND position, and with a number of pills disposed on a component of the container.

Referring to FIG. 2, in one example embodiment, when container 2 is assembled, each of protrusions 18,20 extends at least partially into a corresponding one of slots 58,60, preferably extending through slots 58,60. In the position depicted in FIG. 2, a FIRST position, protrusions 18,20 are each located at a periphery of enlarged portions 62,66 (see FIG. 1) and are preferably biased away from each other. Accordingly, when container 2 is in the FIRST position, first and second protrusions 18,20 are each located in a corresponding one of first and second enlarged portions 62,66 in order to maintain container 2 in the FIRST position. When container 2 is in this FIRST position, first and second components 10,50 form a compartment configured to contain at least one product (e.g., pills 100). Additionally, in accordance with the disclosed concept, container 2 is configured to move between the FIRST position and a SECOND position (see FIG. 4). Specifically, when container 2 moves from the FIRST position (FIG. 2) toward the SECOND position (FIG. 4), first component 10 slides relative to second component 50, thereby providing an opening into the compartment. Once the container 2 has reached the SECOND position, the container 2 is configured to be unable to any slide further in the direction it had moved to reach the SECOND position. The opening into the compartment (with the container 2 in the SECOND position) may be used to access pills 100.

Figure 3:
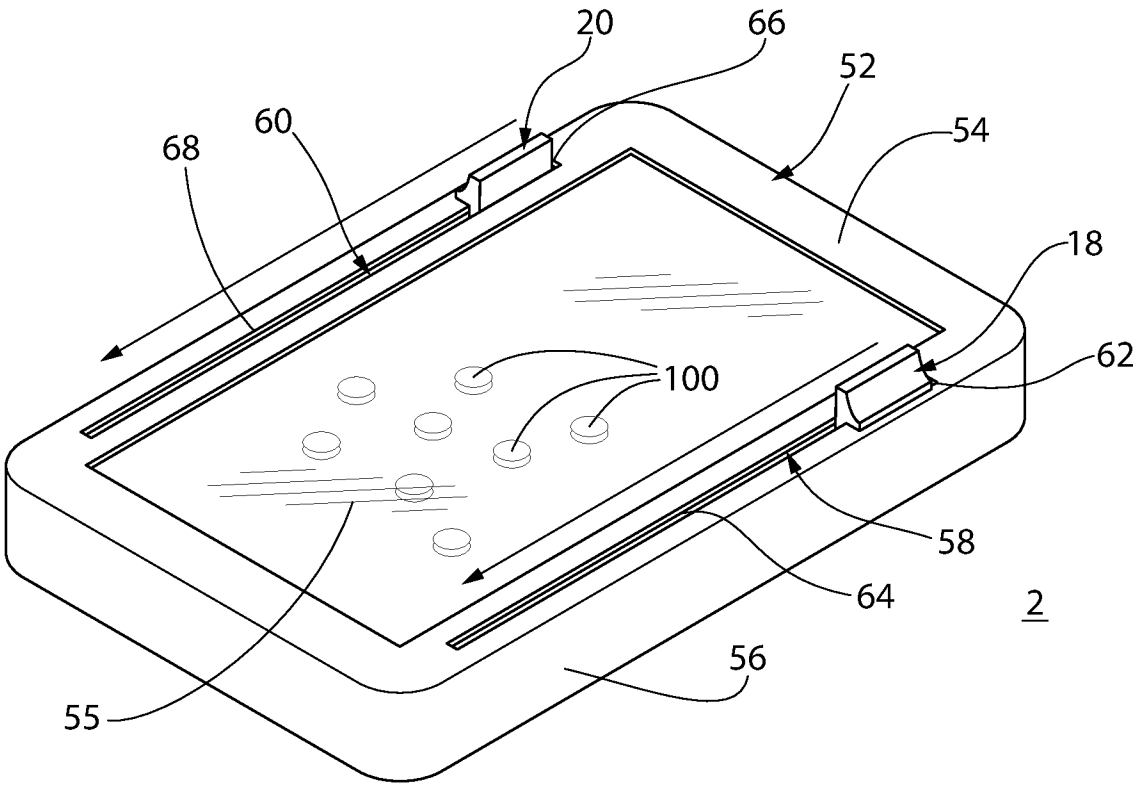
FIG. 3 is another assembled isometric view of the container of FIG. 1, shown with the container having partially moved toward a SECOND position.

In one example embodiment of the disclosed concept, when container 2 moves from the FIRST position (FIG. 2) toward the SECOND position (FIG. 4), first and second protrusions 18,20 initially move toward each other (e.g., are squeezed toward each other by a patient, such as an adult patient who can contemplate the mechanics of opening container 2), thereby allowing first component 10 to slide relative to second component 50. Compare, for example, FIGS. 2 and 3. Specifically, FIG. 3 shows container 2 with protrusions 18,20 pressed closer to each other than in FIG. 2. As such, from the position in FIG. 3, enlarged portions 62,66 of slots 58,60 no longer obstruct protrusions 18,20. That is, in the position of FIG. 2, enlarged portions 62,66 prevent protrusions 18,20, and thus first component 10, from sliding with respect to second component 50. As such, once they have been pressed inwardly, protrusions 18,20 are free to slide in sliding portions 64,68 of slots 58,60 to allow container 2 to be opened. Thus, when container 2 moves from the FIRST position (FIG. 2) toward the SECOND position (FIG. 4), each of first and second protrusions 18,20 slides in a corresponding one of first and second sliding portions 64,68 away from first and second enlarged portions 62,66.

It will thus be appreciated that container 2 provides a novel child-resistant mechanism to contain medicine (e.g., pills 100), while protecting children who might otherwise gain access to contents of a container. Specifically, adults will readily be able to understand that a simple mechanical motion of squeezing protrusions 18,20 toward each other, and then sliding them away from corresponding enlarged portions 62,66 of slots 58,60 will provide an opening into the compartment and thus access to pills 100 located therein. However, to most young children such a motion is not so simple, a feature which protects them from potentially ingesting the medicine.

Continuing to refer to FIGS. 1-4, second component 50 optionally includes a membrane 55 coupled to ceiling portion 54 of body portion 52, and preferably being located between first and second protrusions 18,20. Membrane 55 is substantially transparent in order to allow viewing into the compartment when container 2 is in the FIRST position (FIG. 2). For example, as shown in FIG. 2, pills 100 located in the compartment of container 2 are visible through membrane 55. Additionally, in one example embodiment, membrane 55 is made from a fluorinated ethylene propylene material. While membrane 55 of container 2 is described and shown herein as being provided on second component 50, it will be appreciated that a suitable alternative first component (not shown) may instead or additionally have a membrane substantially the same as membrane 55 in order to provide visibility into the compartment.

Figure 5:
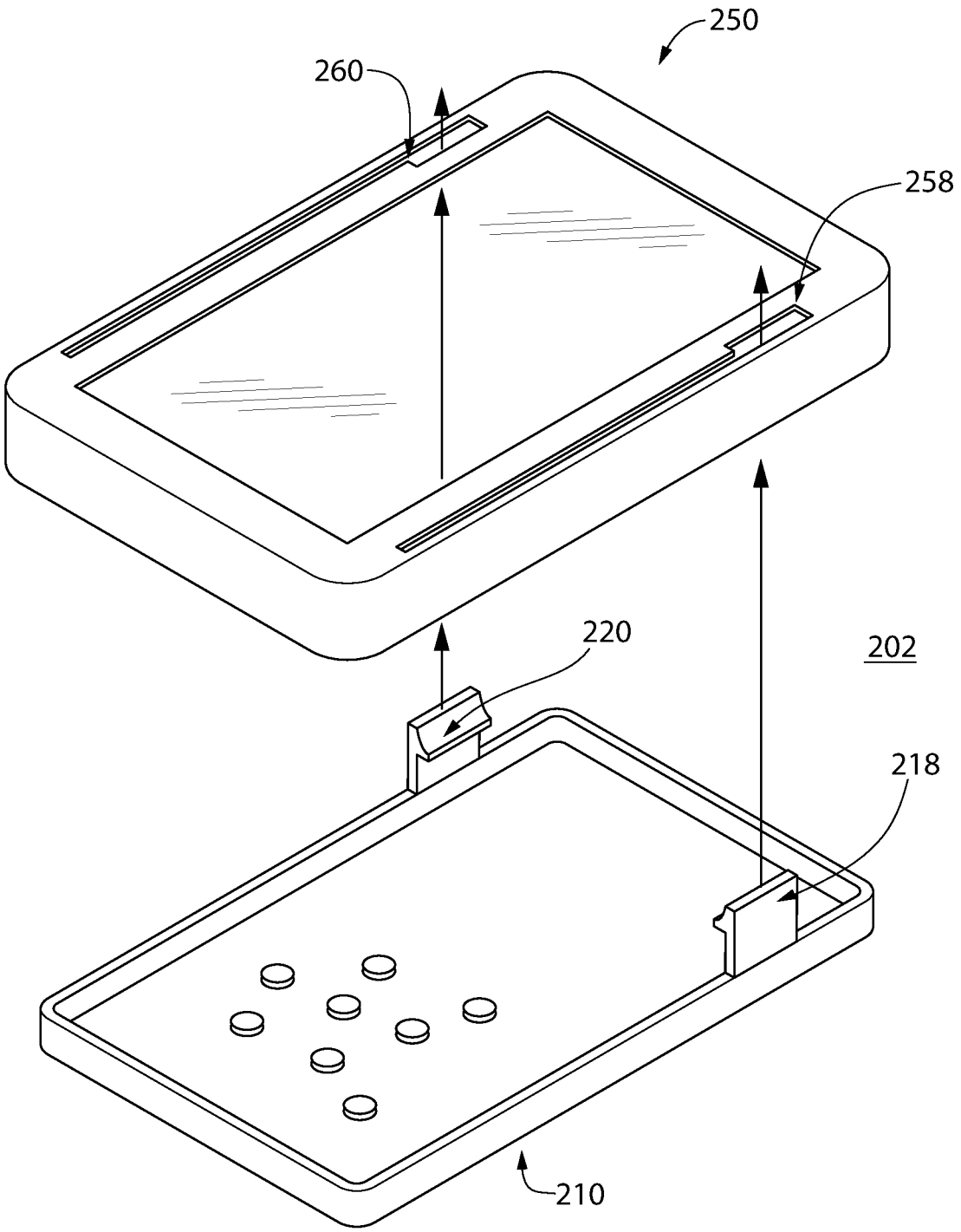
FIG. 5 shows an exploded isometric view of another container, in accordance with another non-limiting embodiment of the disclosed concept.

While the disclosed concept has been described in association with protrusions 18,20 of first component 10 moving toward each other to open container 2, it will readily be appreciated that suitable alternative configurations of containers are contemplated by the disclosed concept. For example and without limitation, FIG. 5 shows another container 202 having first and second components 210,250. When container 202 moves from the FIRST position toward the SECOND position, first and second protrusions 218,220 initially move away from each other, thereby allowing first component 210 to slide relative to second component 250. Compare, for example, the geometry of slots 258,260 of second component 250 to the geometry of slots 58,60 of second component 50 (FIG. 1). Specifically, when container 202 in the FIRST position, protrusions 218,220 engage against inner edges of slots 258,260, and upon moving toward the SECOND position, are pressed outwardly toward and/or are engaged against outer edges of slots 258,260. When container 2 (FIGS. 1-4) is in the FIRST position (FIG. 2), by way of contrast, protrusions 18,20 engage against outer edges of slots 58,60. Upon moving toward the SECOND position, protrusions 18,20 are pressed inwardly toward and/or are engaged against inner edges of slots 58,60.

Suitable other containers are contemplated by the disclosed concept. For example and without limitation, in a suitable alternative container (not shown), when the container moves from a FIRST position toward a SECOND position, the first and second protrusions may initially move away from the body portion of the second component, thereby allowing the first component to slide relative to the second component.

The disclosed concepts have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein, it is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed:

1. A child resistant container comprising:

a first component having a first coupling mechanism; and a second component having a second coupling mechanism slidably coupled to the first coupling mechanism, wherein the first component comprises a first body portion having a floor portion and a peripheral rim, wherein the first coupling mechanism comprises a number of protrusions extending in a common direction away from the peripheral rim, the peripheral rim extending in the common direction away the floor portion, wherein the second component comprises a second body portion, wherein the second coupling mechanism comprises a number of slots formed in the second body portion, wherein the container is configured to move between a FIRST position and a SECOND position, wherein, when the container is in the FIRST position, the floor portion, the peripheral rim, and at least a portion of the second component together form a compartment configured to contain at least one product, and wherein, when the container moves from the FIRST position toward the SECOND position, the first component slides relative to the second component, thereby providing an opening into the compartment, and wherein the number of protrusions each include a portion that is received in a corresponding slot of the number of slots in both the FIRST position and the SECOND position.

2. The container according to claim 1, wherein each another portion of a protrusion of the number of protrusions is situated at a free end of the protrusion.

3. The container according to claim 1, wherein the number of slots comprises a first slot and a second slot disposed opposite the first slot; wherein the number of protrusions comprises a first protrusion and a second protrusion disposed opposite the first protrusion; and wherein the portion of each of the first protrusion and the second protrusion is received in a corresponding one of the first slot and the second slot.

4. The container according to claim 3, wherein, when the container moves from the FIRST position toward the SECOND position, the first protrusion and the second protrusion initially move toward each other, thereby allowing the first component to slide relative to the second component.

5. The container according to claim 3, wherein, when the container moves from the FIRST position toward the SECOND position, the first protrusion and the second protrusion initially move away from each other, thereby allowing the first component to slide relative to the second component.

6. The container according to claim 3, wherein, when the container moves from the FIRST position toward the SECOND position, the first protrusion and the second protrusion initially move one of toward one another and away from one another, thereby allowing the first component to slide relative to the second component.

7. The container according to claim 3, wherein the first slot comprises a first enlarged portion and a first sliding portion extending from the first enlarged portion; wherein the second slot comprises a second enlarged portion and a second sliding portion extending from the second enlarged portion; and wherein, when the container is in the FIRST position, each of the first protrusion and the second protrusion is disposed in a corresponding one of the first enlarged portion and the second enlarged portion in order to maintain the container in the FIRST position.

8. The container according to claim 7, wherein, when the container moves from the FIRST position toward the SECOND position, each of the first protrusion and the second protrusion slides in a corresponding one of the first sliding portion and the second sliding portion away from the first and second enlarged portions.

9. The container according to claim 1, wherein at least one of the first component and the second component comprises a body portion and a membrane coupled to the body portion; and wherein the membrane is substantially transparent in order to allow viewing into the compartment when the container is in the FIRST position.

10. The container according to claim 9, wherein the membrane is made from a fluorinated ethylene propylene material.

11. The container according to claim 1, wherein the number of protrusions extend parallel with one another in the common direction away from the first body portion.

12. The container according to claim 1, wherein the number of protrusions are situated on the peripheral rim.

* * * * *